US008419463B2

(12) United States Patent
Taguchi

(10) Patent No.: US 8,419,463 B2
(45) Date of Patent: Apr. 16, 2013

(54) COAXIAL CONNECTOR

(75) Inventor: Hiroyuki Taguchi, Kohtoh-ku (JP)

(73) Assignee: Fujikura Ltd., Tokyo (JP)

( * ) Notice: Subject to any disclaimer, the term of this patent is extended or adjusted under 35 U.S.C. 154(b) by 0 days.

(21) Appl. No.: 13/360,305

(22) Filed: Jan. 27, 2012

(65) Prior Publication Data

US 2012/0122339 A1 May 17, 2012

Related U.S. Application Data

(63) Continuation of application No. PCT/JP2010/062787, filed on Jul. 29, 2010.

(30) Foreign Application Priority Data

Jul. 31, 2009 (JP) ..... 2009-178487

(51) Int. Cl.
*H01R 13/58* (2006.01)

(52) U.S. Cl.
USPC ..... 439/449

(58) Field of Classification Search ..... 439/63, 439/188, 944, 736, 79, 669, 668
See application file for complete search history.

(56) References Cited

U.S. PATENT DOCUMENTS

| | | | | |
|---|---|---|---|---|
| 6,474,995 | B1 * | 11/2002 | Wu | 439/63 |
| 7,118,383 | B2 * | 10/2006 | Nagata et al. | 439/63 |
| 2004/0102061 | A1 | 5/2004 | Watanabe | |
| 2006/0024985 | A1 | 2/2006 | Nagata et al. | |
| 2006/0141811 | A1 | 6/2006 | Shichida et al. | |
| 2009/0149063 | A1 | 6/2009 | Yotsutani | |
| 2009/0298333 | A1 | 12/2009 | Yotsutani | |

FOREIGN PATENT DOCUMENTS

| | | | |
|---|---|---|---|
| JP | 2004-063372 | A | 2/2004 |
| JP | 2006-066384 | A | 3/2006 |
| JP | 2006-185773 | A | 7/2006 |
| JP | 2009-104836 | A | 5/2009 |
| JP | 2009-140687 | A | 6/2009 |

* cited by examiner

*Primary Examiner* — Tulsidas C Patel
*Assistant Examiner* — Phuongchi Nguyen
(74) *Attorney, Agent, or Firm* — Sughrue Mion, PLLC

(57) ABSTRACT

A surface mount type coaxial connector 1 to be mounted on a circuit wiring board 50 comprises: a contact 10 for signals having a cylindrical fitting portion 11 for signals divided by first slits 111a housing 20 having a circular convex portion 22 which surrounds the fitting portion 11 for signals via a first space $S_1$; and a ground shell 30 having a circular fitting portion 32 for ground which surrounds the convex portion 22 via a second space $S_2$, and the contact 10 for signals, the housing 20, and the ground shell 30 are integrally formed by insert molding.

6 Claims, 12 Drawing Sheets

COAXIAL CONNECTOR

BACKGROUND OF THE INVENTION

1. Technical Field of the Invention

The present invention relates to a coaxial connector of surface mount technology (SMT) type to be mounted on a circuit wiring board.

It is to be noted that the contents described and/or illustrated in the documents relevant to Japanese Patent Application No. 2009-178487 filed on Jul. 31, 2009 and International Application PCT/JP2010/62787 filed on July 28, 2010 will be incorporated herein by reference, as a part of the description and/or drawings of the present application.

2. Description of the Related Art

As a surface mount type coaxial connector, a connector is known which comprises a U-shaped contact conductor for signal connection, an insulator base having a projecting portion of which a transparent hole is provided therein with the contact conductor for signal connection, and a cylindrical contact conductor for ground connection enclosing the insulator base (for example refer to Patent Document 1).

In this coaxial connector, the projecting portion of the insulator base is placed between the contact conductor for signal connection and the contact conductor for ground connection in order to prevent undue deformation of the contact conductor for signal connection. In addition, this coaxial connector is configured such that the contact conductor for signal connection and the contact conductor for ground connection are press fitted into the insulator base.

PRIOR ART DOCUMENT(s)

[Patent Document(s)]

[Patent Document 1] Japanese unexamined Patent Publication No. 2009-140687

SUMMARY OF THE INVENTION

[Problems to be Solved by the Invention]

For a surface mount type coaxial connector, lower profile is required in addition to reduced size (reduced space). Whereas, the above press fitting type coaxial connector has limitations with respect to making lower profile, because it is necessary to ensure thickness of the insulating base so as to be able to endure the pressing fitting.

On the other hand, employing insert molding method may provide a possibility of lower profile. However, according to the above coaxial connector, it becomes difficult to ensure the projecting portion between the contact conductor for signal connection and the contact conductor for ground connection as the coaxial connector is reduced in size, because the contact conductor for signal connection is of U-shaped form.

Problems to be solved by the present invention include providing a surface mount type coaxial connector which is capable of being in reduced size and lower profile.

[Means for Solving the Problems]

According to the present invention, there is provided a surface mount type coaxial connector to be mounted on a circuit wiring board, comprising: a conductor for signals having a cylindrical fitting portion for signals in which a slit is formed along an axial direction; an insulator having a circular convex portion which surrounds the fitting portion via a first space; and a conductor for ground having a circular fitting portion for ground which surrounds the convex portion via a second space, wherein the conductor for signals, the insulator, and the conductor for ground are integrally formed by insert molding.

[Advantageous Effect of the Invention]

According to the present invention, the shape of the fitting portion for signals is made as being cylindrical one in which the slit is formed along the axial direction, and the conductor for signals, the insulator, and the conductor for ground are integrally formed by insert molding, so that a reduced size and a low profile are allowed.

DESCRIPTION OF THE PREFERRED EMBODIMENT

Hereinafter, an embodiment according to the present invention will be described with reference to the drawings.

Figure 5:
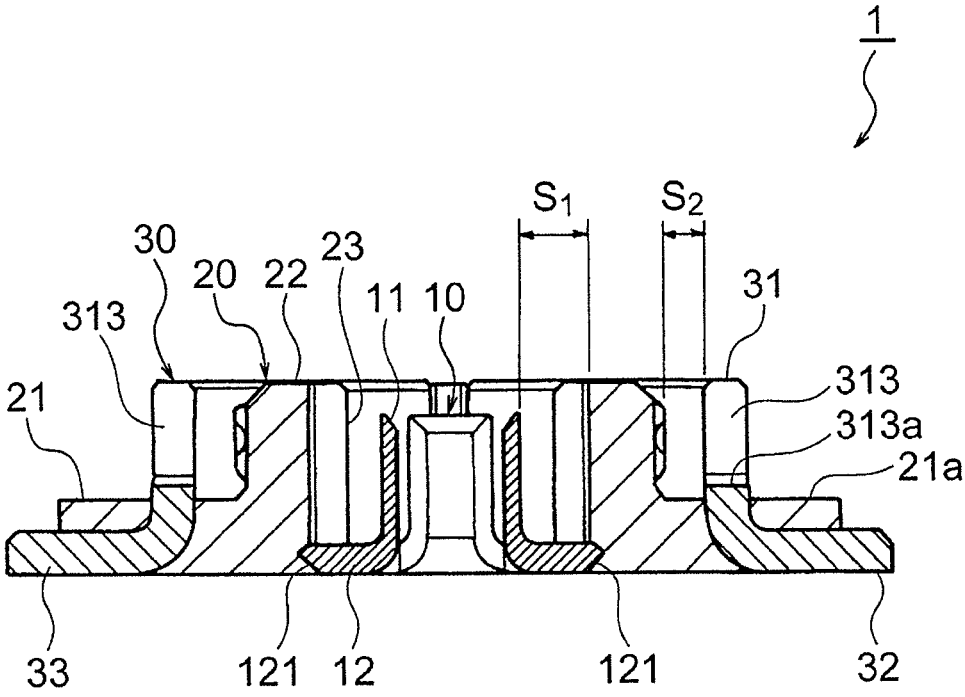
FIG. 5 is a cross-sectional view along line V-V in FIG. 2.
Figure 6:
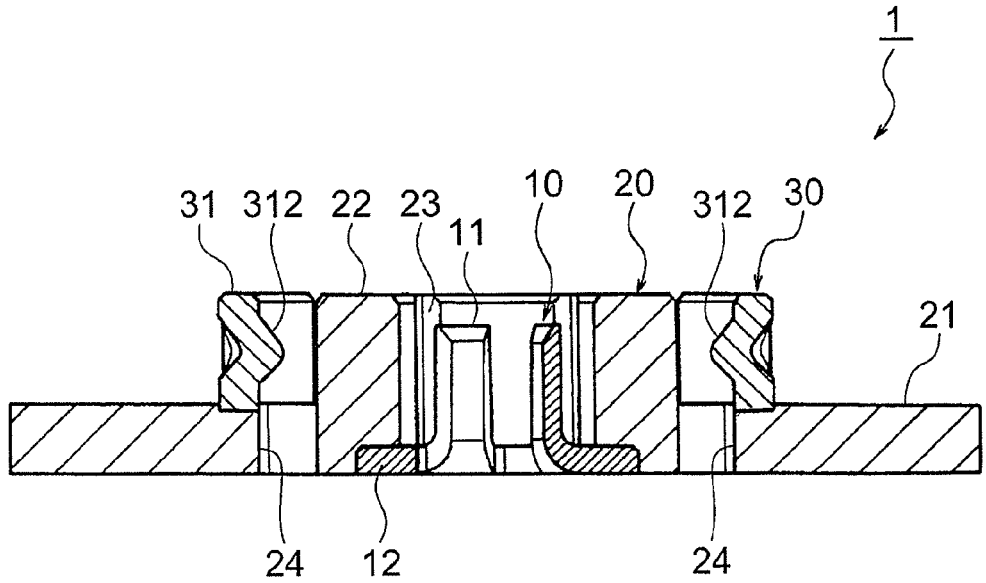
FIG. 6 is a cross-sectional view along line VI-VI in FIG. 2.
Figure 7:
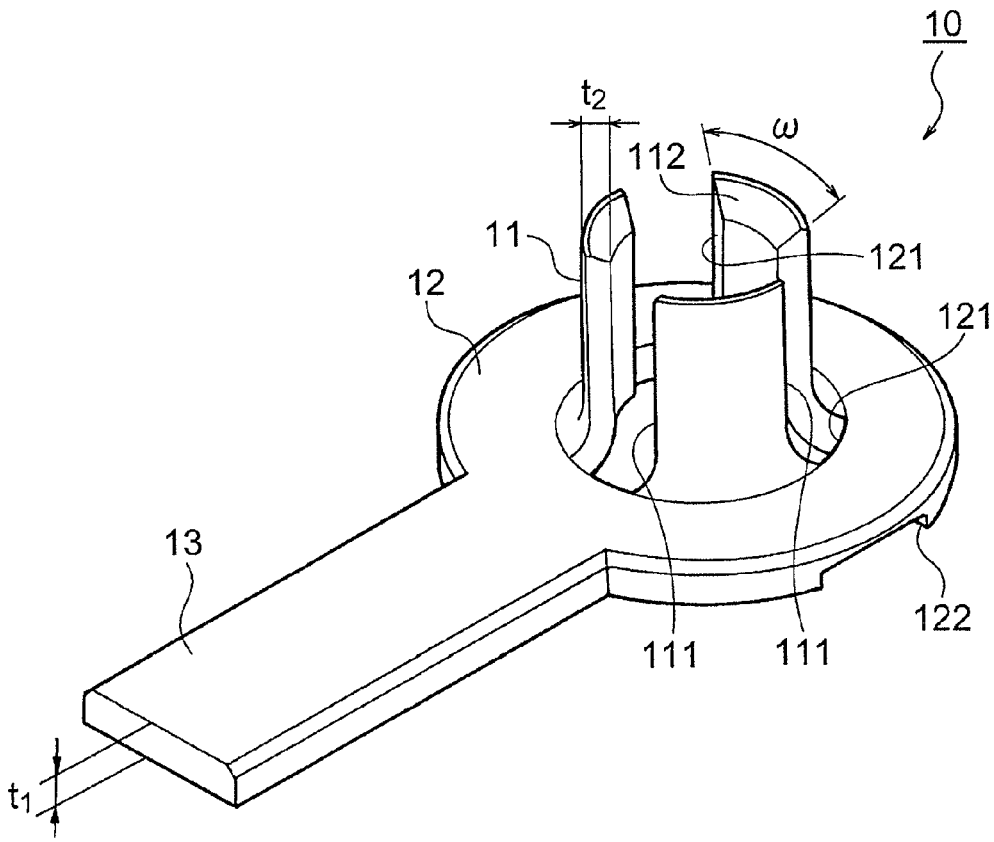
FIG. 7 is a perspective view of a contact in the embodiment of the present invention.
Figure 8:
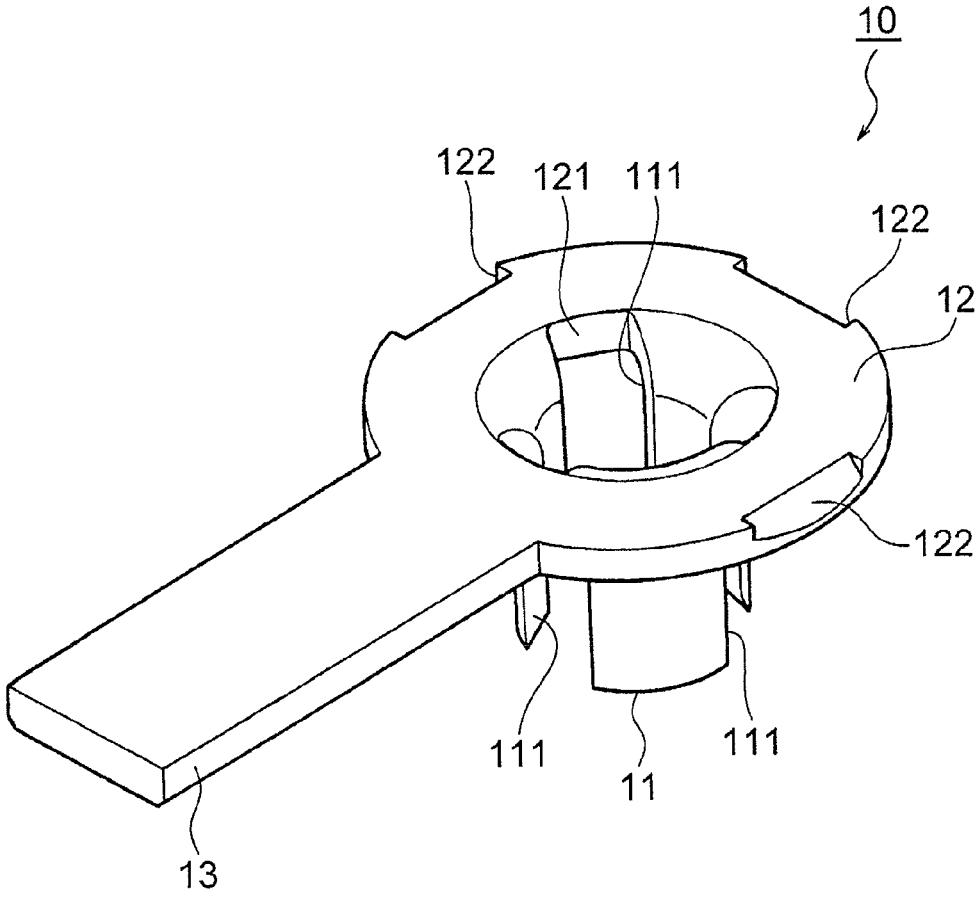
FIG. 8 is a view from below the contact shown in FIG. 7.
Figure 9:
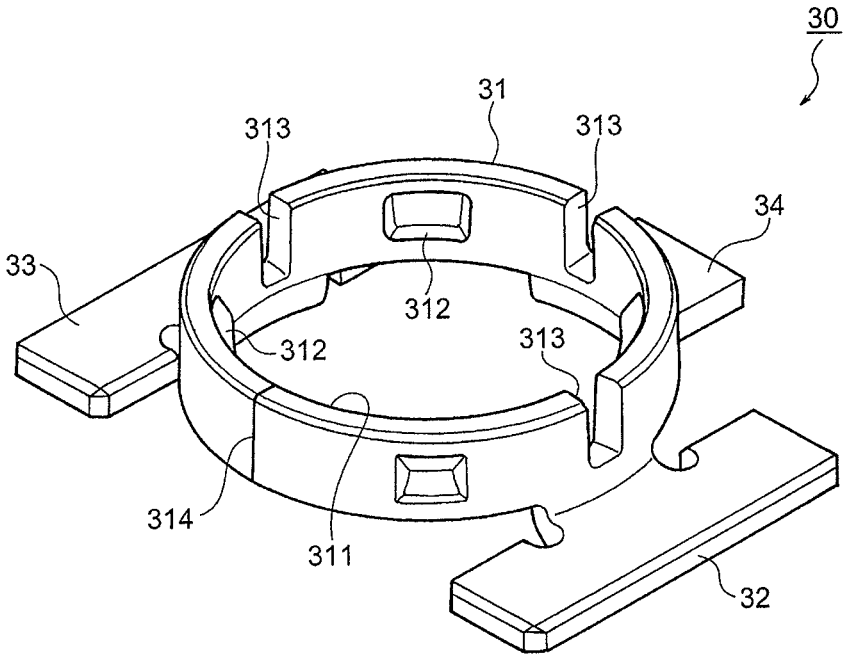
FIG. 9 is a perspective view of a ground shell in the embodiment of the present invention.
Figure 10:
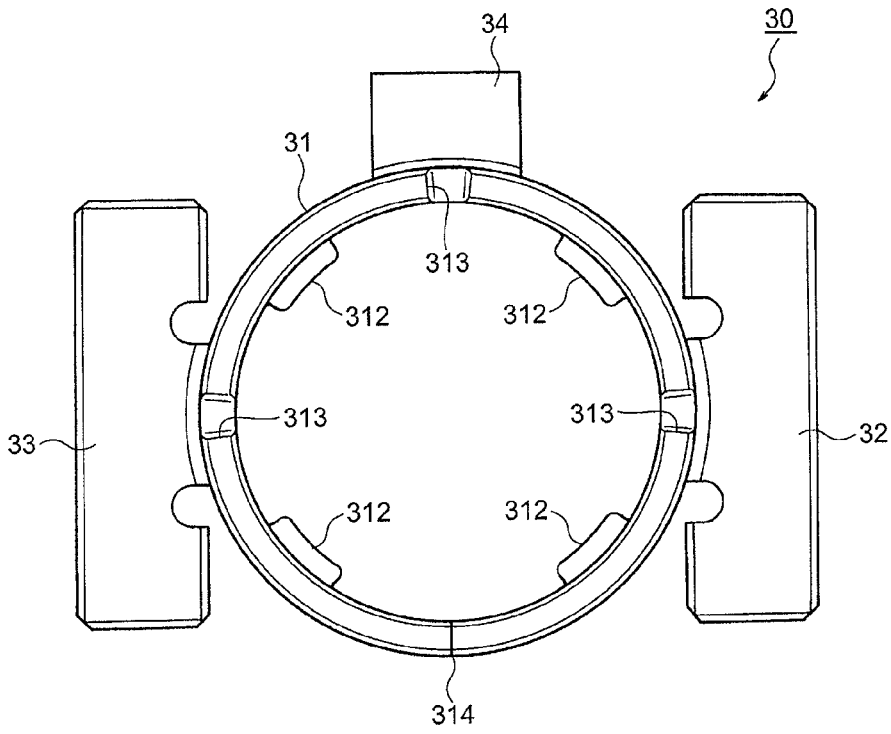
FIG. 10 is a plan view of the ground shell shown in FIG. 9.
Figure 11:
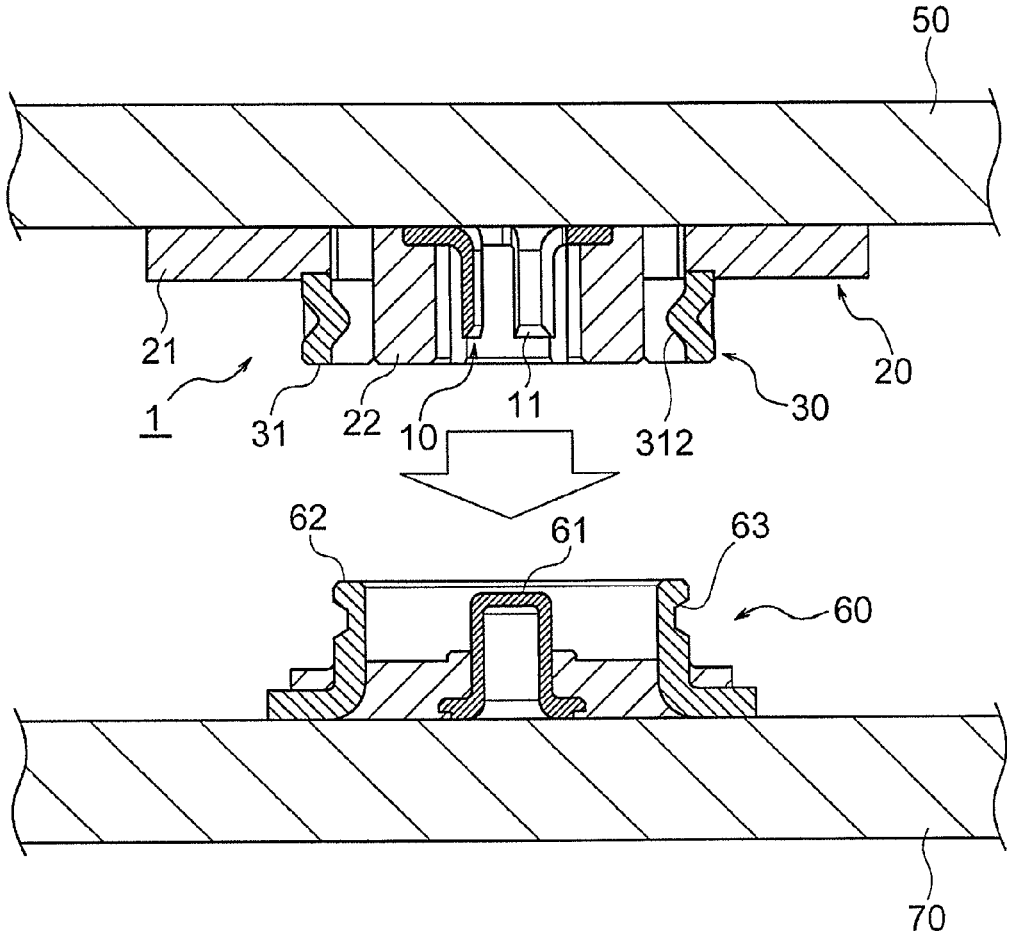
FIG. 11 is a cross-sectional view (part 1) illustrating the fitting operation for the coaxial connector in the embodiment of the present invention.
Figure 12:
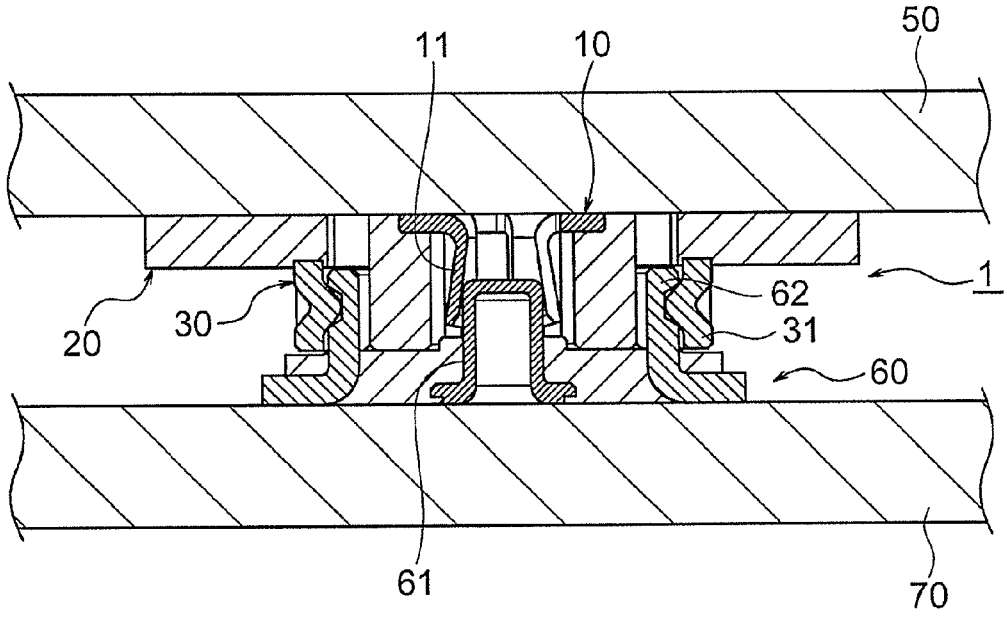
FIG. 12 is a cross-sectional view (part 2) illustrating the fitting operation for the coaxial connector in the embodiment of the present invention.

FIG. 1 to FIG. 6 are views illustrating a coaxial connector in the present embodiment, FIG. 7 and FIG. 8 are views illustrating a contact in the present embodiment, FIG. 9 and FIG. 10 are views illustrating a ground shell in the present embodiment, and FIG. 11 and FIG. 12 are views illustrating the fitting operation for the coaxial connector in the present embodiment.

Figure 1:
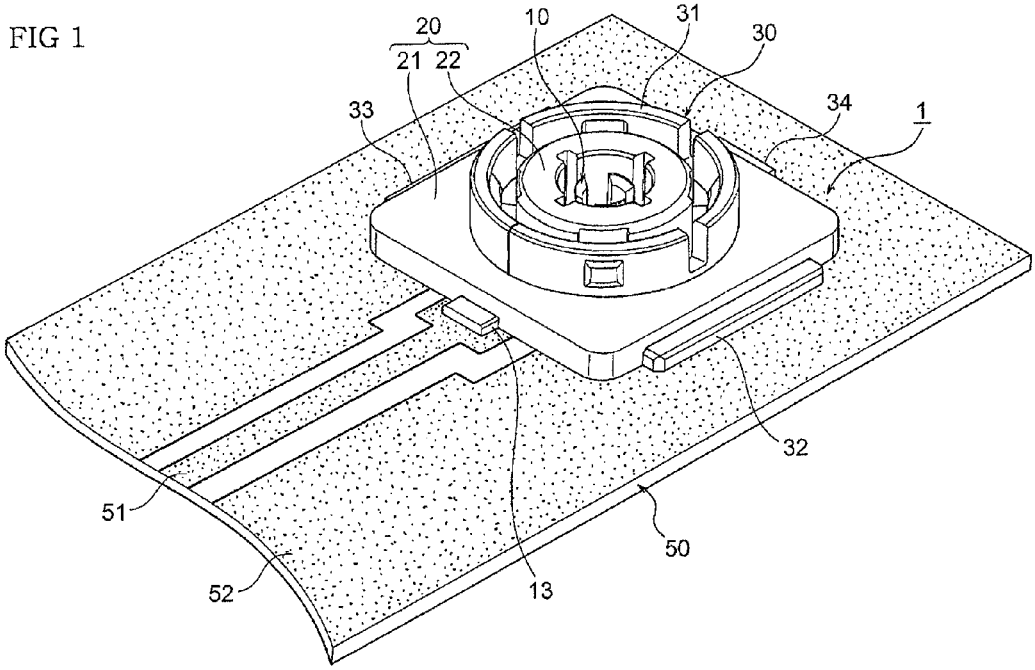
FIG. 1 is a perspective view of a coaxial connector in an embodiment of the present invention.
Figure 2:
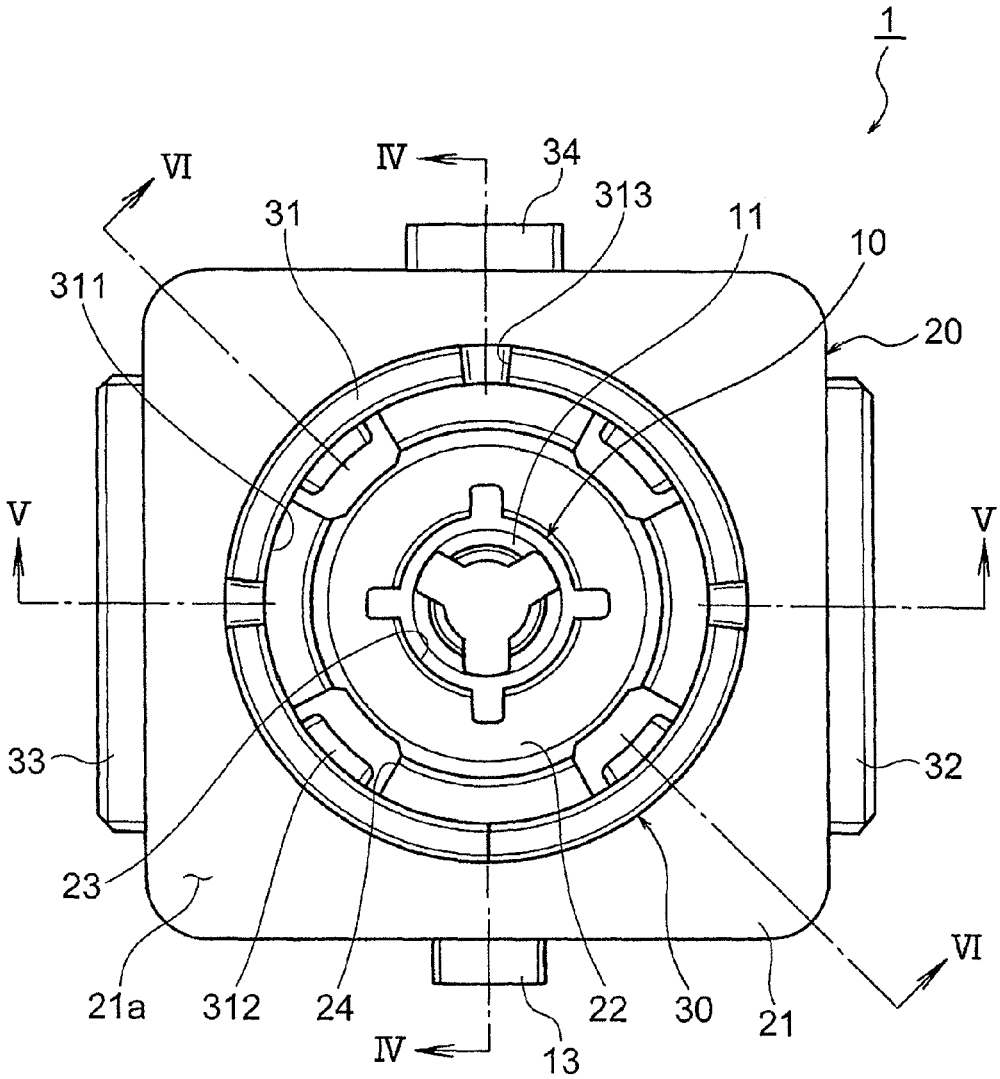
FIG. 2 is a plan view of the coaxial connector shown in FIG. 1.
Figure 3:
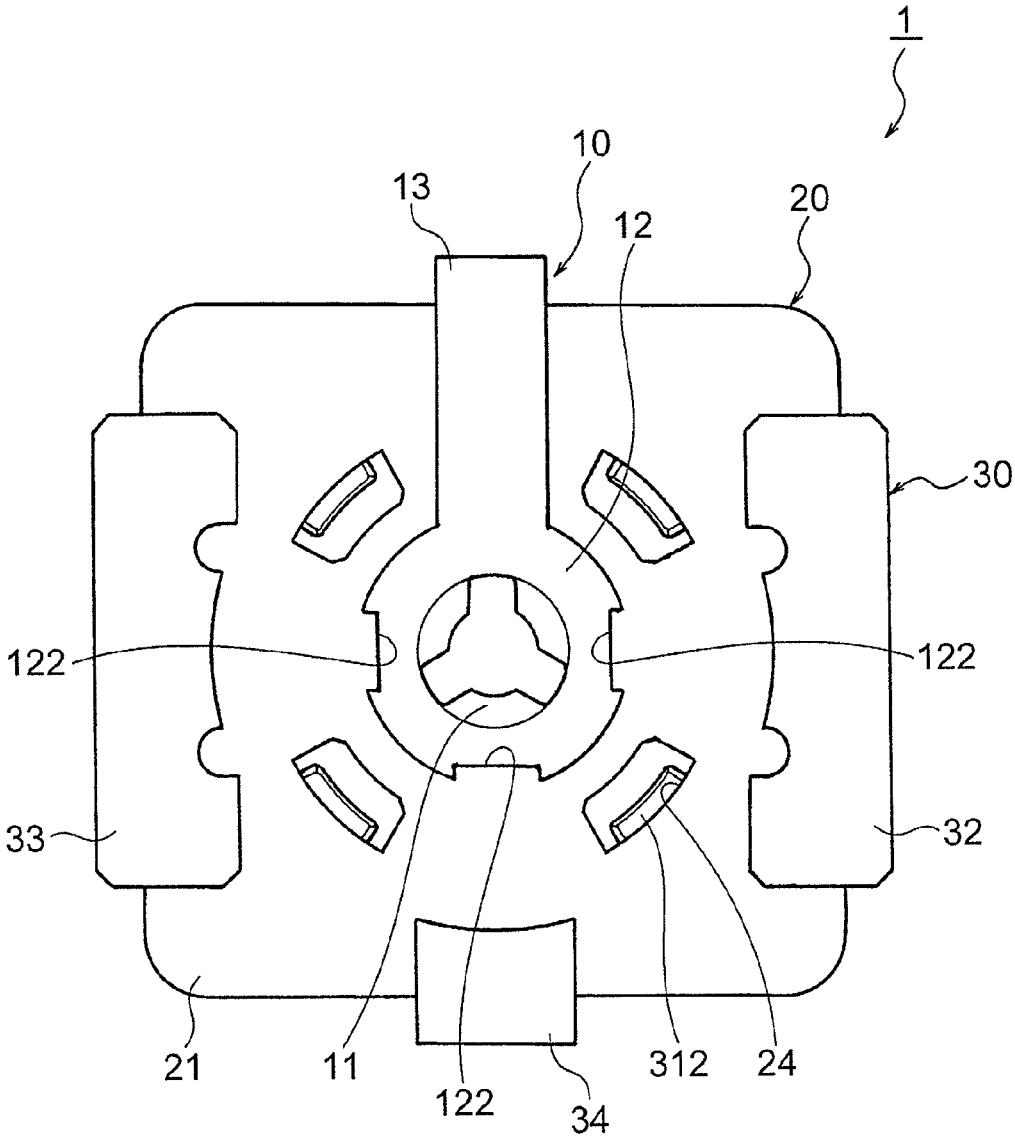
FIG. 3 is a bottom view of the coaxial connector shown in FIG. 1.

As shown in FIG. 1, the coaxial connector 1 in the present embodiment is a surface mount type connector to be mounted on a circuit wiring board 50, and is used for mobile information processing terminal devices, such as mobile phones, PDAs (Personal Digital Assistants) and notebook-size personal computers, or various types of electronic devices, for example. Note that, as the circuit wiring board 50 to be mounted thereon with this coaxial connector 1, a flexible printed circuit (FPC) board, a rigid printed circuit board (PCB), etc. may be mentioned, for example.

This coaxial connector 1 comprises, as also shown in FIG. 2 to FIG. 6, a contact 10 for signals, a housing 20 and a ground shell 30, which are integrally formed by insert molding in the present embodiment.

The contact 10 has, as shown in FIG. 7 and FIG. 8, a fitting portion 11 for signals to which a fitting portion 61 for signals (refer to FIG. 11 and FIG. 12) of a counterpart connector 60 is fitted by insertion, a supporting portion 12 which supports the fitting portion 11, and a signal terminal 13 to be connected with a signal pattern 51 on the circuit wiring board 50.

The fitting portion 11 has a cylindrical shape divided by three first slits 111. These three first slits 111 are formed along the axial direction of the fitting portion 11, and are arranged with substantially equal intervals along the circumferential direction of the fitting portion 11. Moreover, ends 112 of the fitting portion 11 are formed to be tapered inward, thereby allowing the fitting portion 61 of the counterpart connector 60 to be readily inserted therein.

Note that, although the first slits 111 are formed over the entire length along the axial direction of the fitting portion 11, the first slits 111 may be formed partially along the axial direction of the fitting portion 11. Note further that the number of the first slits 111 formed in the fitting portion 11 is not particularly limited, and one or two slits or four or more slits may be formed in the fitting portion for signals.

Thus, the cylindrical shape fitting portion 11 is divided by the first slits 111, thereby allowing the fitting portion 11 of the contact 10 to be elastically deformed when fitted therein by insertion with the fitting portion 61 of the counterpart connector 60.

Moreover, as previously described, the conventional conductor for signal connecting is of U-shaped form while the signal connecting conductor of the counterpart connector has cylinder-solid form, and they are thus in point contact with each other. In contrast, according to the present embodiment, the fitting portion 11 of the contact 10 for signals is of cylindrical shape and the fitting portion 61 of the counterpart connector 60 has corresponding cylinder-solid form, and they are thus in surface contact with each other thereby to improve the contact stability between the fitting portions 11 and 61 for signals.

Furthermore, while the contact force (constant of spring) of the fitting portion 11 depends on the width w of the fitting portion 11 (refer to FIG. 7), the present embodiment employs the fitting portion 11 having cylindrical shape, which allows the dedicated area for the fitting portion 11 with respect to that spring width to be reduced compared to the conventional U-shaped one, thereby it is possible to ensure sufficient contact force even if being compact size.

The supporting portion 12 of the contact 10 has ring-shape with an inner opening 121 and the fitting portion 11 rises upward from the inner opening 121. In addition, chamfered areas 122 are partially formed to be inclined outward at outer peripheral of the rear surface of the supporting portion 12 (opposite surface to the surface provided thereon with the fitting portion 11 to rise up). When forming the coaxial connector 1 by insert molding, resin material constituting the housing 20 flows into these chamfered areas 122 thereby to prevent the contact 10 from dropping out from the housing 20. Note that a chamfered area 122 may be formed along the entire outer peripheral of the rear surface of the supporting portion 12.

Additionally, a flat-plate-like terminal 13 for signals extends outward from a part of the outer peripheral of the supporting portion 12. When the coaxial connector 1 is formed by insert molding, one end of this terminal 13 is caused to lead out from the housing 20. Thereafter, when the coaxial connector 1 is mounted on the circuit wiring board 50, this terminal 13 is soldered with the signal pattern 51 of the circuit wiring board 50 (refer to FIG. 1).

The fitting portion 11, the supporting portion 12 and the terminal 13 of the contact 10 are formed continuously by processing one metal plate material. Examples of such materials constituting the contact 10 include phosphor bronze, beryllium copper, brass, stainless steel, titanium/copper alloy, etc, for example.

Particularly in the present embodiment, the fitting portion 11 is formed by drawing, and the thickness $t_2$ of the fitting portion 11 is thus relatively thinner compared to the thickness $t_1$ of the terminal 13 ($t_2<t_1$, refer to FIG. 7). Consequently, the strength and the spring performance of the fitting portion 11 are improved by work-hardening even if being compact size.

The housing 20 has, as shown in FIG. 1 to FIG. 6, a flat-plate-like main body portion 21 embedded therein with portions of the contact 10 and the ground shell 30, and a convex portion 22 for preventing undue deformation of the fitting portion 11 of the contact 10. This housing 20 is composed of a resin material such as liquid crystal polymer (LCP), poly phenylene sulfide (PPS) resin, or poly butylene terephthalate (PBT), etc, wherein the main body portion 21 and the convex portion 22 are integrally formed.

Substantially center areas of the main body portion 21 and the convex portion 22 are formed therein with a first penetrating hole 23 in which the fitting portion 11 of the contact 10 is coaxially disposed. The inner diameter of this first penetrating hole 23 is larger than the outer diameter of the fitting portion 11 thereby forming a first space $S_1$ (refer to FIG. 5) between the first penetrating hole 23 and the fitting portion 11.

In addition, four of second penetrating holes 24 are formed in circular arc fashion around the convex portion 22 at the main body portion 21. These second penetrating holes 24 are arranged with equal intervals along the circumferential direction of the convex portion 22 and located at positions where projections 312 (described later) of the ground shell 30 are projected onto the main body portion 21 along the axial direction of the convex portion 22.

Providing such second penetrating holes 24 allows metallic molds to access the projections 312 from both upper and lower directions during insert molding, thereby ensuring the shape of projections 312 protruding.

As shown in FIG. 9 and FIG. 10, the ground shell 30 comprises a fitting portion 31 for ground to be fitted by insertion with a ground shell 62 (refer to FIG. 11 and FIG. 12) of the counterpart connector 60, and three terminals 32 to 34 for ground to be connected with a ground pattern 52 (refer to FIG. 1) of the circuit wiring board 50.

The fitting portion 31 has a circular shape with an inner opening 311 in which the convex portion 22 of the housing 20 is coaxially disposed. The inner diameter of this inner opening 311 is larger than the outer diameter of the convex portion 22 of the housing 20 thereby forming a second space $S_2$ (refer to FIG. 5) between the inner opening 311 and the convex portion 22.

According to the present embodiment, because the fitting portion 11 for signals has cylindrical shape and the fitting portion 31 for ground has circular shape, and in addition thereto, the fitting portions 11 and 31 are coaxially arranged, higher frequency signals are thus enabled to be treated compared to the conventional U-shaped one.

Inner surface of this fitting portion 31 for ground is formed thereon with the four projections 312. The four projections 312, which protrude respectively toward the center of the inner opening 311, are arranged with substantially equal intervals along the circumferential direction of the inner opening 311. Note that the number and the arrangement of the projections 312 to be formed on the fitting portion 31 are not particularly limited.

Thus, intermittently providing the projections 312 of the ground shell 30 ensures that the projections 312 at four points and the ground shell 62 of the counterpart connector 60 are reliably connected with one another and that the contacting areas are reduced so as to increase the contacting force per unit area (contacting pressure) compared to employing a continuous projection, thereby it is possible to ensure stable contact reliability.

Moreover, as described above, the second penetrating holes 24 of the housing 20 are necessary for obtaining the protruding shapes of the projections 312 during insert molding. For this reason, if a projection is formed in a circular shape for the ground shell of a coaxial connector employing insert molding, then a second penetrating hole of the housing is required to be formed also in a circular shape, thus separating the housing due to that second penetrating hole. In contrast, according to the present embodiment, the projections 312 of the ground shell 30 are intermittently provided thereby it is possible that the coaxial connector 1 is formed by insert molding.

This fitting portion 31 is formed therein with three of second slits 313 along the axial direction, and the second slits 313 allow the circular-shaped fitting portion 31 to elastically deform so that the fitting portion 31 is able to fit with a ground shell 62 of the counterpart connector 60. Note that the number and the arrangement of slits to be formed in the fitting portion for ground are not particularly limited.

Figure 4:
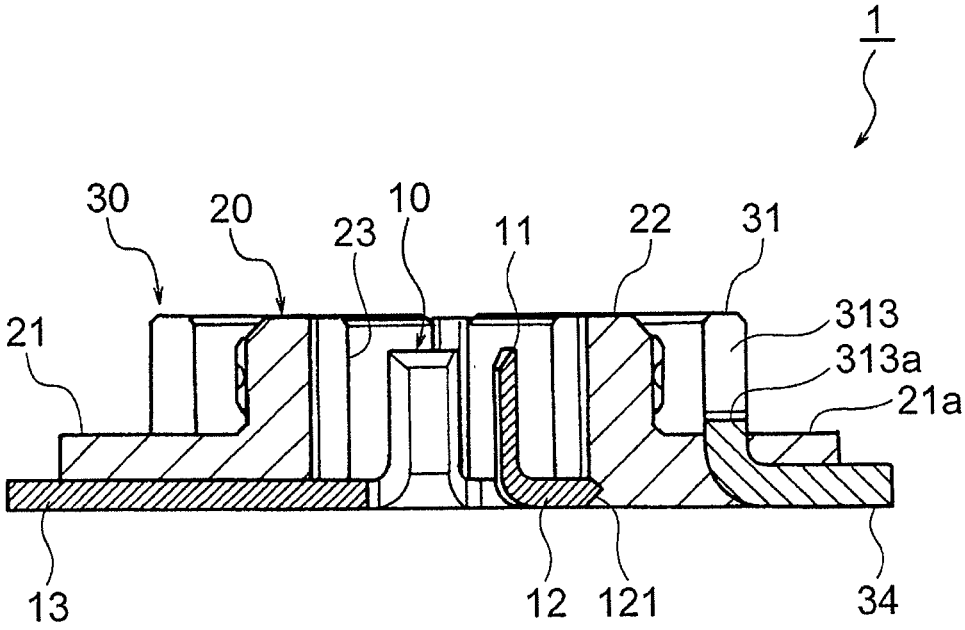
FIG. 4 is a cross-sectional view along line IV-IV in FIG. 2.

According to the present embodiment, these second slits 313 have lower ends 313*a* which are located at higher positions than the upper surface 21*a* of the main body portion 21 of the housing 20 (refer to FIG. 4). When forming the coaxial connector 1 by insert molding, such a positional relationship may prevent resin material from entering into the first slits 111, thereby to suppress an occurrence of a crack in the housing 20 during the fitting of the coaxial connector 1.

Three terminals 32 to 34 for ground respectively extend outward from the outer peripheral of this fitting portion 31. When the coaxial connector 1 is formed by insert molding, ends of these terminals 32 to 34 are caused to lead out toward three directions from the housing 20. Thereafter, when the coaxial connector 1 is mounted on the circuit wiring board 50, the terminals 32 to 34 are soldered with the ground pattern 52 (refer to FIG. 1) of the circuit wiring board 50.

The fitting portion 31 and the terminals 32 to 34 of the ground shell 30 are formed continuously by processing one metal plate material. Examples of such material constituting the ground shell 30 include phosphor bronze, beryllium copper, brass, stainless steel, titanium/copper alloy, etc, for example. Note that, although a joint line 314 is formed for the fitting portion 31 due to the above processing of the metal plate material, the gap of the joint line 314 is preferred to be narrow as much as possible in order to prevent the resin material from entering into this joint line 314.

The above described coaxial connector 1 is formed by insert molding. That is, after setting the contact 10 and the ground shell 30 into a mold for insert molding, resin material constituting the housing 20 is injection molded into that mold thereby integrally forming the contact 10, the housing 20 and the ground shell 30.

At this time, as shown in FIG. 4 to FIG. 6, the supporting portion 12 of the contact 10 and the lower portion of the fitting portion 31 of the ground shell 30 are embedded in the main body portion 21 of the housing 20. In addition, the terminal 13 of the contact 10 and the terminals 32 to 34 of the ground shell 30 are also embedded in the main body portion 21 of the housing 20 except for respective one ends thereof.

On the other hand, the fitting portion 11 of the contact 10 is exposed in the insertion hole 23, and the first space $S_1$ is formed between the outer surface of the fitting portion 11 and the inner surface of the insertion hole 23.

In addition, the upper portion of the fitting portion 31 of the ground shell 30 is also exposed from the main body portion 21 of the housing 20, and the second space $S_2$ is formed between the inner surface of the fitting portion 31 and the outer surface of the convex portion 22.

As shown in FIG. 11 and FIG. 12, the coaxial connector 1 and the counterpart connector 60 are connected with each other as the fitting portion 61 for signals of the counterpart connector 60 is fitted by insertion into the fitting portion 11 for signals of the coaxial connector 1 and the fitting portion 62 for ground of the counterpart connector 60 is fitted by insertion into the fitting portion 31 for ground of the coaxial connector 1.

During this connection, since the first slits 111 are formed in the fitting portion 11 of the contact 10 and the first space $S_1$ is formed between the fitting portion 11 and the convex portion 22, the elastic deformation of the fitting portion 11 is allowed.

Similarly, the second slits 313 are also formed in the fitting portion 31 of the ground shell 30 thereby to allow the elastic deformation of the fitting portion 31. Moreover, the second space $S_2$ is formed between the fitting portion 31 and the convex portion 22 thereby allowing the fitting portion 62 for ground of the counterpart connector 60 to be fitted by insertion.

The projections 312 of the fitting portion 31 for ground of the coaxial connector 1 are then engaged with the groove 63 of the fitting portion 62 for ground of the counterpart connector 60 so as to lock the connection between the coaxial connector 1 and the counterpart connector 60.

As described above, according to the present embodiment, the coaxial connector 1 is configured such that the contact 10 for signals, the housing 20 and the ground shell 30 are integrally formed by insert molding, thereby to allow a low profile of the coaxial connector 1.

Moreover, according to the present embodiment, the shape of the fitting portion 11 of the contact 10 for signals is selected as being cylindrical shape divided by the first slits 111, thereby it is possible to ensure the convex portion 22 of the housing 20 between the fitting portion 11 of the contact 10 and the fitting portion 31 of the ground shell 30 even if forming the coaxial connector 1 of compact size by insert molding.

Therefore, the coaxial connector 1 according to the present embodiment is compatible with both the reduced size and the low profile.

It is to be noted that the embodiments as explained above are described to facilitate understanding of the present invention and are not described to limit the present invention. Therefore, it is intended that the elements disclosed in the above embodiments include all design changes and equivalents to fall within the technical scope of the present invention.

Description of Reference Numerals

1 . . . coaxial connector
- 10 . . . contact (conductor for signals)
  - 11 . . . fitting portion for signals
    - 111 . . . first slit
  - 12 . . . supporting portion
  - 122 . . . chamfered area
  - 13 . . . terminal for signals
- 20 . . . housing (insulator)
  - 21 . . . main body portion
    - 21*a* . . . upper surface
  - 22 . . . convex portion
    - 23 . . . first penetrating hole
    - 24 . . . second penetrating hole
- 30 . . . ground shell (conductor for ground)
  - 31 . . . fitting portion for ground

312 . . . projection
313 . . . second slit
313*a* . . . lower end
32 to 34 . . . terminals for ground
50 . . . circuit wiring board
$S_1$ . . . first space
$S_2$ . . . second space

What is claimed is:

1. A surface mount type coaxial connector to be mounted on a circuit wiring board, comprising:

a conductor for signals having a cylindrical fitting portion for signals in which a first slit is formed along an axial direction;

an insulator having a circular convex portion which surrounds the cylindrical fitting portion via a first space; and a conductor for ground having a circular fitting portion for ground which surrounds the circular convex portion via a second space, wherein the conductor for signals, the insulator, and the conductor for ground are integrally formed by insert molding, and wherein the entire cylindrical fitting portion is deformable.

2. The coaxial connector as set forth in claim 1, wherein:

the circular fitting portion for ground has a plurality of projections protruding toward the circular convex portion; and the plurality of projections are intermittently arranged on an inner surface of the circular fitting portion for ground along a circumferential direction of the circular fitting portion for ground.

3. The coaxial connector as set forth in claim 2, wherein the insulator has penetrating holes which face the projections along an axial direction of the circular convex portion.

4. The coaxial connector as set forth in claim 1, wherein:

the conductor for signals has a supporting portion which supports the cylindrical fitting portion for signals; and at least a portion of an outer peripheral area of the supporting portion is chamfered.

5. The coaxial connector as set forth in claim 4, wherein:

the insulator has a main body portion positioned below the circular convex portion; and a lower portion of the circular fitting portion for ground and the supporting portion are embedded in the main body portion.

6. The coaxial connector as set forth in claim 5, wherein:

a second slit is formed in the circular fitting portion for ground along an axial direction of the circular fitting portion for ground; and a lower end of the second slit is positioned above an upper surface of the main body portion.

* * * * *